US005219123A

United States Patent [19]

Jacob

[11] Patent Number: 5,219,123

[45] Date of Patent: Jun. 15, 1993

[54] PROCESS FOR THE SELECTIVE RECLAMATION TREATMENT OF USED FOUNDRY SAND

[75] Inventor: Hermann Jacob, Seevetal, Fed. Rep. of Germany

[73] Assignee: Georg Fischer AG, Schaffhausen, Switzerland

[21] Appl. No.: 745,009

[22] Filed: Aug. 14, 1991

[30] Foreign Application Priority Data

Aug. 16, 1990 [CH] Switzerland ..... 02663/90

[51] Int. Cl.[5] ..... B02C 19/12

[52] U.S. Cl. ..... 241/5; 241/23; 241/24; 241/DIG. 10; 164/5

[58] Field of Search ..... 241/5, 23, 24, DIG. 10, 241/79.3; 164/5

[56] References Cited

U.S. PATENT DOCUMENTS

| | | | |
|---|---|---|---|
| 3,871,438 | 3/1975 | Vissers et al. | 164/5 |
| 4,283,015 | 8/1981 | Smith | 241/5 |
| 4,566,637 | 1/1986 | Deve | 241/23 |
| 4,674,691 | 6/1987 | Didion | 241/8 |
| 4,700,766 | 10/1987 | Godderidge | 164/5 |
| 4,960,162 | 10/1990 | Millager | 164/5 |
| 5,115,985 | 5/1992 | Satmer et al. | 241/14 |

*Primary Examiner*—Mark Rosenbaum
*Assistant Examiner*—John M. Husar
*Attorney, Agent, or Firm*—Bachman & LaPointe

[57] ABSTRACT

A process for the selective reclamation treatment of used foundry sands wherein separation of parts of the binding materials from the basic granular material is effected by mechanical means and, thereafter, the sand grains are accelerated to produce an abrasive action of the individual sand grains with one another. The treated grains are then separated into large and small grains and further treatment is effected on the small grains.

11 Claims, No Drawings

PROCESS FOR THE SELECTIVE RECLAMATION TREATMENT OF USED FOUNDRY SAND

BACKGROUND OF THE INVENTION

The present invention relates to a process for the selective reclamation treatment of used foundry sands for reuse in foundry sand mold in place of new sand.

Iron and steel foundry molding technology uses resources which depend greatly on the requirements and constraints of environmental compatibility. This is particularly the case with molding sand which determines to a great extent the moldability of a casting mold.

A differentiation is made in the technology between natural sand and synthetic sands. The latter are pure, usually washed and classified quartz sands without any additions of organic and/or inorganic additives or impurities.

The pure sand described above, with its grain composition determined by the size of the individual grains, has to be made moldable by additions of precisely determined and measured additives of an organic and inorganic nature.

In the normal molding sand cycle of an iron and steel foundry, that is with clay-bonded wet cast sand, the greatest portion of the used sand collected at the emptying point of a casting is conveyed via a preparation plant for re-use in the wet cast molding operation. This used sand is a mixture of predominantly clay-bonded molding sand and smaller amounts of chemically bonded core sand which was first introduced into the cycle via the core molding as new sand. Still active bonding clay (bentonite) and carbonaceous residues, especially carbonized porous coal dust, is regularly contained in the used sand. In addition, the sand grains are subject to increasing structural change with repeated circulation as part of the bonding clay is dead-burned by the effect of the heat of the cast metal and remains stuck to the quartz grains as a ceramic porous surface layer (so-called oolithisation the art).

Process technologies have been developed and used which separate the used additives, such as bentonite and carbonaceous residues, from the quartz grains so as to convey at least the quartz sand, collected in large amounts, for further re-use. This separation of quartz sand and used binding agent etc. has varied success in these processes especially with respect to the residues still surrounding the individual grains after separation. The total percentage amount of these residuals is determined by trial methods know in the art. The determined parameters are combined under the headings annealing loss, slurry, sieve analysis and pH value determination, and determine in their entirety the further re-use of the sand.

The sand quality parameters employed represent a total value of a specific sand test quantity. In practice, however, the sand as it occurs for reclamation is assessed in its entirety without reference to its grain size composition.

Thus, in the prior art the quality assessments of a sand, that is a measurement of these parameters, do not take into account the size of the individual grains but only the resulting average value of the test sand quantity. However, present mixing processes and apparatus belonging thereto make possible an extremely uniform and homogenous distribution of binding materials to the surfaces of the sand grains. This means that the addition of binding material is related to weight and not surface area. The proportional surfaces of a test quantity of sand means that the binding material dosing does not relate to the number of small or larger grains but rather to the weight quantity.

However, in practice gravimetrically similar test amounts of sand, separated according to larger and smaller grains, have completely different surfaces.

If one proceeds from the fact that the surface charging with additives of larger and smaller grains is the same, this means that a gram of large grains, has in total less binding material than the same comparative amount of small grains because of the larger surface ratios.

In the prior art, totality of the occurring sand to be reclaimed in its entirety, regardless of which system technology it is treated with, undergoes a blanket cleaning process with respect to time and energy application. A differentiating factor with regard to time, system technology and hence energy application should be called for.

Accordingly, it is the principle object of the present invention to provide a process for the reclamation of used foundry sand in which treatment of the sand is carried out selectively based on the differences in grain size of the sand. In accordance with the present invention, a uniform degree of purification of the quartz sand grains can be achieved irrespective of their grain size.

SUMMARY OF THE INVENTION

The foregoing object is achieved by way of the present invention wherein a process is provided for the treatment of used foundry sand so as to produce a reclaimed sand suitable for use as foundry sand in place of new sand.

According with the process of the present invention, the used foundry sand is mechanically separated from the foundry casting mold material. The separated used foundry sand is thereafter subjected to acceleration wherein an abrasive action between individual sand grains is achieved such that the binding material is separated from the individual sand grains. The separated grains are thereafter divided into large grains and small grains (by small grains is meant grains having a grain diameter of about less than or equal to 0.1 mm) and then the small sand grains are subjected to further treatment for removing any contaminant casing of residual binding material still adhering to the small sand grains. In accordance with the preferred embodiment of the present invention, the small sand grains are treated by means of a thermal treatment which reduces stresses in the contaminant casing until the casing bursts and can be separated by dust removal from the grain.

DETAILED DESCRIPTION

The first step of the process is a basic mechanical treatment of the foundry casting mold and sand wherein separation of sand and lumps, crushing of the lumps, separation of foreign bodies such as iron particles, wood and glass residues and the like, takes place. Removal of dust, possibly drying of the sand and cooling insofar as it is necessary may also be provided.

The second process step comprises a qualified treatment of the sand content. In this step the sand is further cleaned by the effect of friction and abrasion, pressure cleaning and possibly thermal treatment technology. The separation of carbonized, sintered or burned-off binding portions from the quartz grain takes place here.

The thermal treatment stage of the sand, if used, should be used very sparingly in this step.

After this second process step, the sand is examined to determine the above-mentioned parameters of annealing loss, slurry content and pH value and to carry out the sifting analysis.

Up to this point, the sand is treated in its entirety, irrespective of the grain size contained in the sand mixture. The following table shows, however, that after the above-described first and second process steps the reclaimed sand has the following annealing losses and slurry values, depending on the grain size.

| grain size | annealing loss | slurry material |
|---|---|---|
| 0.5 mm | 0.65% | 0.37% |
| 0.09–0.125 mm | 0.92% | 0.68% |
| 0.06–0.09 mm | 1.18% | 1.58% |

The values above clearly demonstrate that with increasing grain size and the same length of treatment and intensity the values get better and better, that is, a coarse sand is purer than a small-grained sand. However, since in present-day assessment of sand one proceeds from a respective mixed value the good coarse sand is uniformly negatively affected by the small or fine sand.

Thus, in accordance with the present invention, in order to eliminate this negative effect, a selection must be made between large and small grains. Thus in a third process step in accordance with the invention, the sand mass is divided according to grain sizes and the small grains (diameters of less than or equal to 0.1 mm) which have proved to contain a higher amount of slurry and annealing loss, are conveyed for further abrasive treatment which may include intensive heat treatment. The heat treatment can include both a temperature increase and/or a temperature decrease. In the case of treatment at elevated temperatures according to the invention one continues only until the binder layer has burst open. There is no combustion.

However, it is also possible, by temperature decrease (icing), at minus 15 to minus 20° C., to introduce into the surrounding binders those thermal stresses which make possible embrittlement of the surrounding layer. After that the sand mass is conveyed to a further mechanical reclamation so that in this process step the so-called "contaminant" casing can be burst open resulting in a grain which is now pure.

When the cleaning of the small grains is completed these grains are again added to the rest of the sand material and further conveyed in the sand cycle.

EXAMPLE

In a predetermined quantity of a sand to be reclaimed, the binding material content was separated from the basic granular material. The pre-cleaned sand material was then subjected to pneumatic accelerated-abrasive treatment prior to separation of the large and the small grains which was carried out with the aid of a sieve. It has been shown that about 25% of the sand material was separated out as small grains. By a small grain is meant a grain in which the grain diameter does not exceed 0.1 mm. The separated-out small grain material was heated for a predetermined time to a temperature of about 300° C. until sufficient thermal stresses were built up in the contaminant casing to cause embrittlement of the casing. After that, the sand material is treated mechanically or pneumatically until the contaminant casing has completely burst open from each grain.

The process described is particularly environmentally friendly because, in contrast to the known thermal processes, no combustion occurs so that there is no resultant harmful effect on the environment.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the treatment of used foundry sand so as to produce a reclaimed sand suitable or reuse as foundry sand in place of new sand comprises:

(a) mechanically separating said used foundry sand from a foundry casting mold;

(b) accelerating said separated used foundry sand so as to produce an abrasive action between individual sand grains so as to separate binding materials from said sand grains;

(c) subjecting said sand grains to further separation wherein said sand grains are separated into large sand grains and small sand grains wherein said small sand grains have a grain diameter of about less than or equal to 0.1 mm; and (d) treating said small sand grains so as to remove any contaminant casing of residual binding material from said grains.

2. A process according to claim 1 including treating said small sand grains by thermal treatment.

3. A process according to claim 2 wherein said thermal treatment comprises heating said small sand grains to a temperature of up to about 300° C.

4. A process according to claim 3 wherein said thermal treatment comprises cooling said small sand grains down to a temperature of about between −15° C. to −20° C.

5. A process according to claim 1 including treating said small sand grains by mechanically washing and subsequently drying said small sand grains.

6. A process according to claim 1 wherein said grains are separated into larger sand grains and smaller grains by sifting.

7. A process for the treatment of used foundry sand so as to produce a reclaimed sand suitable for reuse as foundry sand in place of new sand comprises:

(a) mechanically separating said used foundry sand from a foundry casting mold;

(b) accelerating said separated used foundry sand so as to produce an abrasive action between individual sand grains so as to separate binding materials from said sand grains;

(c) examining said grains so as to determine the parameters of annealing loss and slurry material of the sand grains;

(d) separating those sand grains having high amounts of annealing loss and slurry material from the other of said sand grains wherein said sand grains having high amounts of annealing loss and slurry materials have annealing loss of greater than 0.65% and slurry material of greater than 0.37%; and (e) treating said separated sand grains high in annealing loss and slurry material so as to remove contaminant casings of residual binding material from said grains.

8. A process according to claim 7 including treating said sand grains high in annealing loss and slurry material by thermal treatment.

9. A process according to claim 8 wherein said thermal treatment comprises heating said small sand grains to a temperature of up to about 300° C.

10. A process according to claim 7 wherein said thermal treatment comprises cooling said small sand grains down to a temperature of about between −15° C. to −20° C.

11. A process according to claim 8 wherein said grains are separated into larger sand grains and smaller grains by sifting.

* * * * *